United States Patent [19]

Monne

[11] 3,974,777

[45] Aug. 17, 1976

[54] ROLLING ELEMENT FOR A HANDLING EQUIPMENT AND EQUIPMENTS COMPRISING SUCH ELEMENTS

[76] Inventor: Maxime Monne, 19 bis Boulevard Delessert, 75016 Paris, France

[22] Filed: Oct. 29, 1974

[21] Appl. No.: 518,997

[52] U.S. Cl. ..... 104/94; 104/106; 105/155

[51] Int. Cl.[2] ..... B61B 3/00; E01B 25/22

[58] Field of Search ..... 104/89, 91, 93–95, 104/106–108, 111, 118; 105/148, 150, 154, 155; 187/9 E; 198/177 R, 177 T, 204

[56] References Cited

UNITED STATES PATENTS

| | | | |
|---|---|---|---|
| 1,320,740 | 11/1919 | Coghlin | 104/91 |
| 2,245,135 | 6/1941 | Martin | 104/94 X |
| 2,725,973 | 12/1955 | King | 104/94 X |
| 2,915,169 | 12/1959 | Abbey | 104/94 X |
| 3,392,244 | 7/1968 | Hillmann | 104/94 X |
| 3,834,316 | 9/1974 | Hennings | 104/94 X |

FOREIGN PATENTS OR APPLICATIONS

| | | | |
|---|---|---|---|
| 1,092,926 | 11/1967 | United Kingdom | 104/89 |
| 639,244 | 6/1950 | United Kingdom | 198/177 R |

*Primary Examiner*—John J. Love
*Assistant Examiner*—Andres Kashnikow
*Attorney, Agent, or Firm*—Brisebois & Kruger

[57] ABSTRACT

Hollow rolling element for a handling equipment comprising at least two assembled profiles forming a tubular section opened at its lower part and receiving one or several pony trucks or crane crabs, characterized in that it comprises two sheeting piles located with their concavities confronting each other on both sides of a vertical plane, the lower edges of said sheeting piles being spaced from each other in order to provide a lower elongated opening whereas the upper edges are rigidly fixed on both sides of at least one spacing member.

4 Claims, 5 Drawing Figures

ROLLING ELEMENT FOR A HANDLING EQUIPMENT AND EQUIPMENTS COMPRISING SUCH ELEMENTS

SUMMARY OF THE INVENTION

This invention relates to a rolling element for a handling equipment such as crane railway, monorail, or conveyer track as well as to equipments comprising such elements, especially crane railways, monorails and conveyers.

By rolling elements it is meant particularly are rolling tracks or ways as well as rolling beams or transverse rolling elements of crane railways.

Elements acording to the invention are of the downward open type, i.e. in which the rolling member, crane crab or similar is movable inside the element being provided with downward projecting hooking means.

Crane railways particularly of the floating suspended type are already known having two substantially parallel rolling tracks each comprising a generally hollow elongated element, i.e. of the tubular type including an opening at its lower portion in order to allow the downward projection of the lower part of the crane crabs or pony trucks and/or bearers rolling in said element. Generally a transverse beam is suspended to these pony trucks and also comprises a tubular element open at its lower part in order to allow the downward projection of the lower part of the truck which among others comprises the winch of the crane railway.

These hollow rolling elements are generally made of a tubular C-shaped profile, the section of which comprises an upper horizontal web, two substantially vertical arms which are ending in two substantially horizontal flanges, a gap being left between them for the passage of the suspension or hooking part of the truck or bearer, the rollers of which are rolling on the two flanges or on rails integral with these flanges.

It is also already known to build such rolling elements with two profiles each comprising a vertical web with an upper horizontal arm and a lower horizontal arm, the upper arms being joined together by junction elements. In some cases these two profiles have a relatively simple U-shaped section while in other cases they have a more elaborated section.

Practically, the carrying capacity of such equipments is limited to small loads of less than three tons because the production of such special profiles for the rolling elements by profiling, folding or stamping becomes quickly very expensive when the thickness and the dimensions of the profiles increase. When one uses profiles having a more simple section such as for instance a U-shaped section which are more easily available difficulties are encountered because the upper arms of the profiles are not designed to be easily joined together and it is then necessary to provide junction elements which are more complicated and more difficult to use. As a result, in order to provide equipments such as, for instance, suspended crane railways designed for heavy loads it would be necessary to make the hollow elements by the welding of thick sheets beforehand suitably cut out and such production would in fact be slow and expensive. Furthermore because of its complicated construction such an element would exhibit welding or construction failures. As a consequence, practically these floating suspended crane railways having a high capacity are build with elements such as beams of I-shaped section thereby cancelling all the advantages inherent to hollow profiles.

This invention has for its purpose to solve these problems and to allow the manufacture of hollow rolling elements for handling equipments and especially monorails, crane railways or conveyers of very high capacity by using profiles which are easily commercially available thus allowing to solve the problems inherent to the manufacture, cost and storage standing against the diffusion of crane railways of the floating suspended type of high capacity.

It is remarkable that the search of this solution in using ordinary profiles is in opposition with the habits of this technique in which until now especially for high capacity crane railways it has always been attempted to provide profiles especially designed to the different requirements of the rolling tracks.

This invention has for its object a hollow rolling element for a handling equipment especially crane railways, monorails, conveyers for instance of the floating suspended type and having a high capacity, particularly over three tons, said element comprising at least two assembled profiles forming a tubular section open at its lower part and receiving therein one or several bearers or trucks, characterized in that it comprises two sheeting piles located with their concavities confronting each other on either side of a vertical plane, the lower edges of said sheeting piles being spaced from each other in order to provide a lower elongated opening whereas the upper edges are rigidly fixed on both sides of at least one spacing member.

Sheeting piles are intended to mean such profiles used in civil engineering, public works, in order to build retaining walls, caissons, etc . . . , said steel profiles made by profiling having a symmetry plane and a section comprising principally a web, two arms with same dimensions located on the same side of said web, at an important angle, preferably over 45°, and possibly of 90° said arms ending in edges the direction of which approaches said of the web, said edges being outwardly bent into a hook shape.

These sheeting piles have a width between their edges of at least 300 mm and a height of at least 80 mm, their thickness being of at least 4 mm, and possibly reaching 20 mm and more.

The spacing member inserted between the upper edges of the sheeting piles can be a continuous longitudinal element or profile, or alternatively it is possible to provide several short spacing members spaced from each other along the rolling element.

Preferably the spacing member has a reverse T-shaped section the foot of which comes into contact with the two edges of the sheeting piles, the wings of which suitably slanted come into contact with the internal face of the upper arms of the sheeting piles. The fixation of the sheeting piles to the spacing member can advantageously be made by plug welding. The spacing member can also have other sections such as rectangular or V-shaped sections.

In a particular embodiment transversal reinforcing ribs can be provided at some places on the sheeting piles, said ribs extending on at least a part of the external periphery of each sheeting pile in order to increase the rigidity of the element.

The rollers of the pony trucks or crane crabs are intended to roll directly on the internal face of the lower arms of the sheeting piles but in a preferred embodiment because of the important wear due to the rollers resulting from heavy loads it is possible to locate, as already known, rails on these faces.

This invention has also for its object the equipments and especially crane railways, floating or not, comprising rolling tracks and/or a transverse beam according to the invention, or also equipments such as monorails, and conveyers.

In order that the invention may be better understood several embodiments thereof will now be described, purely by way of illustration and example, with reference to the accompanying drawings on which:

Figure 1:
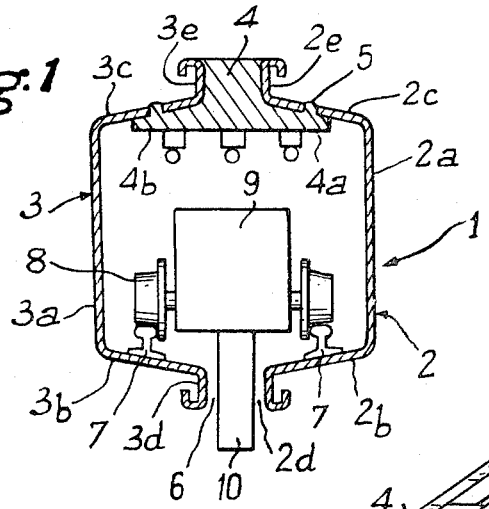
FIG. 1 represents a transverse section of an element according to the invention.
Figure 2:
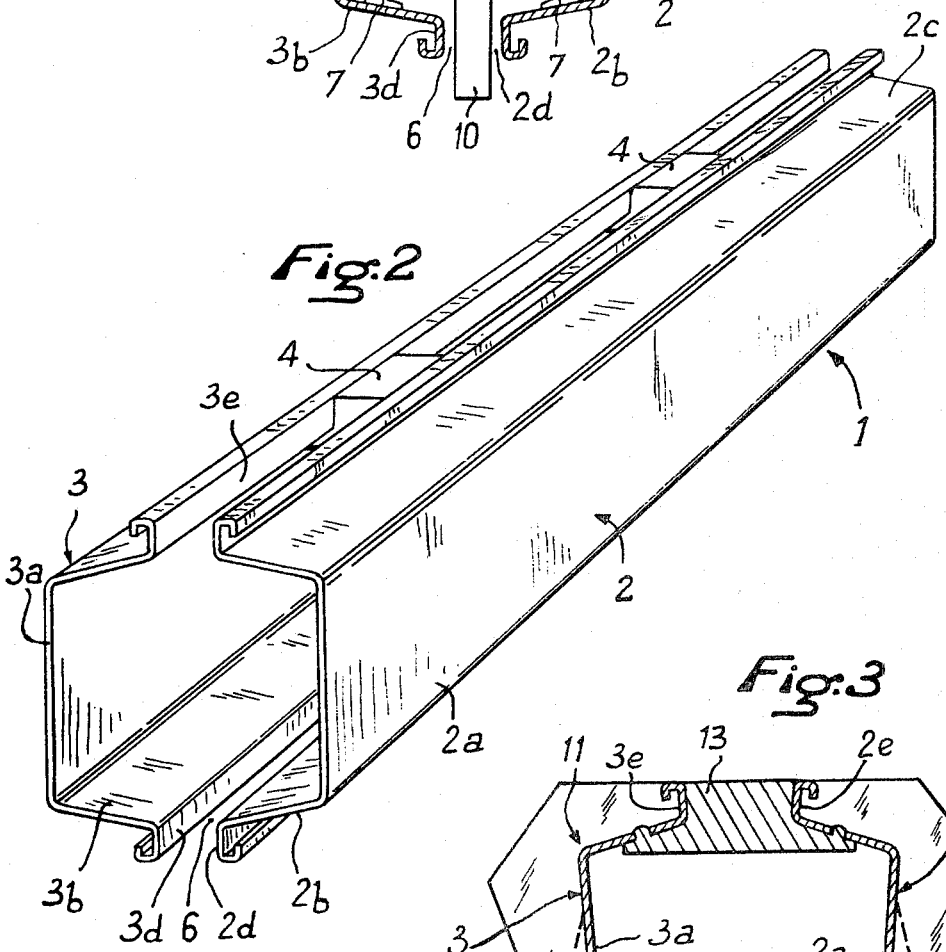
FIG. 2 is a perspective view of this element.

Referring to FIGS. 1 and 2, one can see a rolling track to be suspended in order to become part of a floating crane railway. This element 1 comprises two sheeting piles 2 and 3 located with facing concavities. Each sheeting pile comprises a vertical web 2*a*, respectively 3*a*, a lower side wall 2*b*, respectively 3*b*, and an upper side wall 2*c*, respectively 3*c*, each ending by a flange bent into a hook 2*d*, 2*e* and respectively 3*d*, 3*e*.

One can see that each sheeting pile has a horizontal symmetry plane. In other words the two side walls of a sheeting pile which stand at an angle slightly less than 90° relative to a vertical have the same length.

The two sheeting piles 2 and 3 are fixed at the upper part on spacing members 4 regularly spaced along the element 1.

One can see that the spacing member 4 has a reverse T-shape, the foot of which has two parallel faces against which are applied the internal parallel faces of the two upper flanges 2*e*, 3*e*. The wings of the T are slightly slanted downwardly at an angle corresponding to the slant of the arms 2*c*, 3*c* of the sheeting piles. One can see that a part of the internal faces of said side walls 2*c*, 3*c*, contacts the wings 4*a*, 4*b* of the T. The fixation of the flanges 2*e*, 3*e* and of the side walls 2*c*, 3*c*, with the spacing member 4 is obtained for instance by weldings of the plug type, some of which being shown at 5.

In this manner the two lower edges 2*d*, 3*d* are spaced from each other by a distance equal to the thickness of the foot of the element 4 thus leaving a lower gap 6.

On the internal faces of the two lower side walls 2*b*, 3*b* rails 7 are provided on which are rolling the rollers 8 of trucks 9 forming the bearer of the crane railway. One can see that on the lower face of the T-shaped elements 4 are running conductors for supplying energy to the motor of truck 9. This truck 9 very schematically shown has a lower part 10 which projects through the gap 6 and which is intended to perform the hooking by appropriate means (not shown) of a transverse beam of the crane railway.

One can see that the lower faces of the lower edges 2*d* 3*d* allow, if desired, to provide also a guiding for the lower part 10.

Experiments have shown that the rolling elements thus provided exhibit an important rigidity and very high high load capacity.

Figure 3:
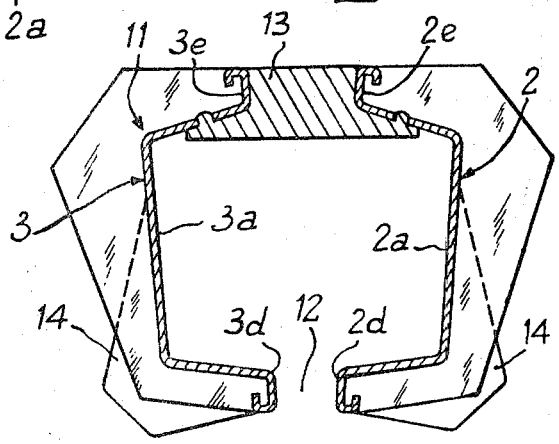
FIGS. 3 and 4 are transverse sections of elements according to other embodiments of the invention.

Referring to FIG. 3, one can see a rolling element 11 comprising two sheeting piles 2 and 3 identical to the aforedescribed sheeting piles. The webs 2*a*, 3*a* of the sheeting piles are not vertical and parallel but on the contrary are downwardly converging so that the opening between the upper flanges 2*e* and 3*e* is larger than the opening 12 between the lower flanges 2*d*, 3*d*. The spacing member 13 has a T-shape which is wider than the member 4 and one can see that the two lateral faces of the foot contacting the internal faces of the flanges 2*e* and 3*e* are located in a manner to downwardly converge.

In some cases, if one wishes to further increase the rigidity of the element 11, it is possible to provide rigidity ribs 14 thereon. In the illustrative embodiment these rigidity ribs are located at the lower part of the sheeting piles 2 and 3, being inserted by means of an appropriate cut-off in the hook of the lower flanges 2*d* and 3*d*. The rigidity ribs extend up to the upper part of the web 2*a*. It would also be possible to provide rigidity ribs on the upper side of the sheeting piles, from the flanges 2*e* and 3*e*, or also rigidity ribs passing over the part 13 and coupling the webs 2*a* and 3*a*. Of course, the rigidity ribs such as 14 shown on the drawings could also extend either up to the flanges 2*e* and 3*e*, or they could extend over the member 13 in order to build a single rib encompassing element 1.

Figure 4:
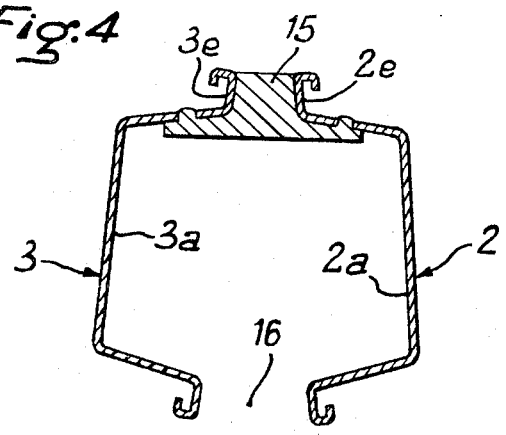

Referring to FIG. 4, two sheeting piles 2 and 3 are also provided but are located in such a way that their webs are downwardly diverging, one can see that in this case the two lateral faces of the foot of the reverse T-shaped member 15 are also downwardly diverging in order to correspond to the slant of the flanges 2*e*, 3*e*. There is thus provided a lower gap 16 which is wider than the distance between the upper flanges 2*e* and 3*e*.

One can thus understand that it is possible with sheeting piles of given dimensions to lessen or increase the width of the lower gap according to the particular requirements of use and this either by lessening or increasing the width of the space available at the upper part of the element.

Thus in the example of FIG. 3 one can see that the upper part of the element located under the member 13 is wider than the lower part of the element. This possibly allows to locate a greater number of conductors or other parts inside the element. On the contrary, in the embodiment of FIG. 4 while keeping a relatively narrow upper part the width of the lower part has been increased thereby allowing to use larger trucks.

Figure 5:
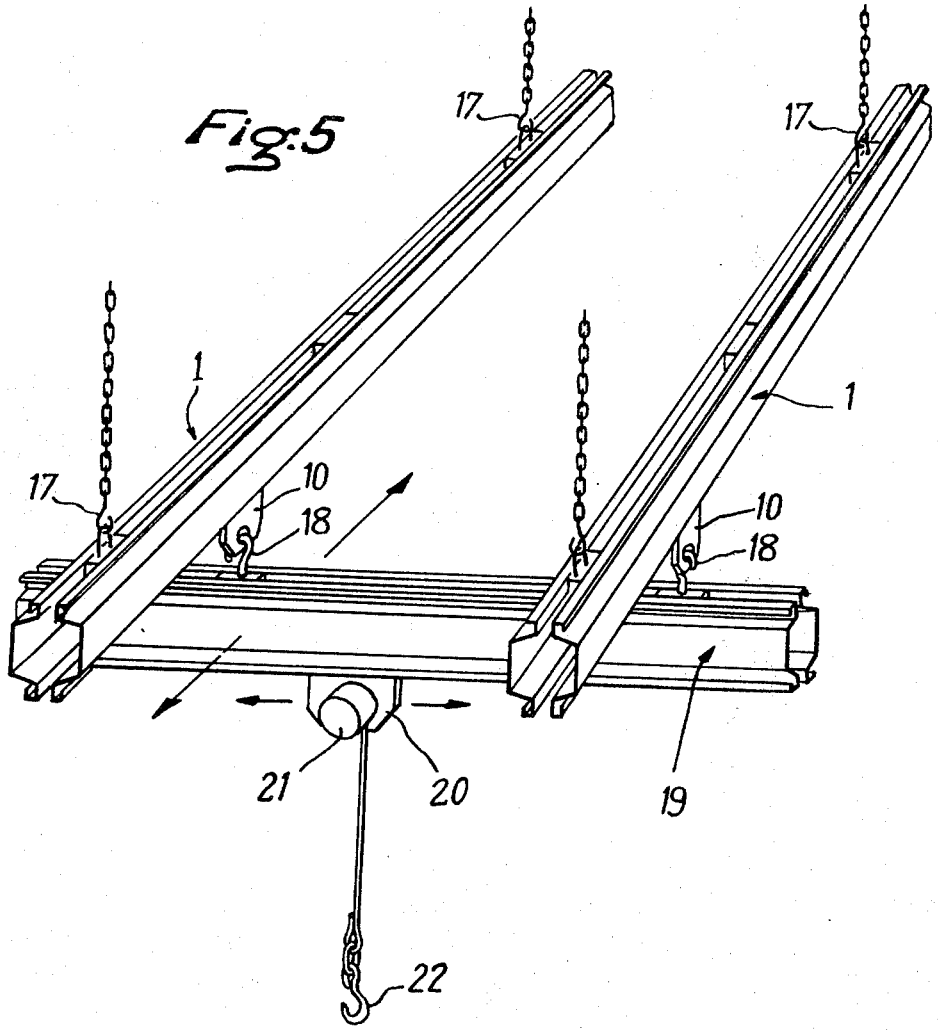
FIG. 5 is a schematic perspective view of a crane railway according to the invention.

Referring to FIG. 5 there is shown crane railway according to the invention, the track of which comprises two elements 1 parallely extending and suspended by hooking means 17 to a frame (not shown). This suspension can be rigid, i.e. the elements 1 are rigidly held against the supporting structure but it can also advantageously be floating.

One can see the lower parts 10 of the two bearers supported under the rolling tracks by pairs of trucks movable in the rolling tracks. By means of hooking means 18 a transverse beam of crane railway 19 also comprising a portion of element 1 is suspended to the two rolling bearers 10.

Inside the beam 19 a truck is movable, a lower part 20 of which is seen downwardly projecting, being provided with a winch 21 with its hook 22.

One can easily understand that the invention allows to provide equipments having a very important span between supports for very heavy loads.

It will, of course, be appreciated that the embodiments which have been described have been given purely by way of illustration and example and may be modified as to detail without thereby departing from the basic principles of the invention.

What is claimed is:

1. In a hollow track member for a material handling installation comprising at least two elongated members defining a longitudinal slot extending longitudinally thereof and adapted to receive at least one traveller, the improvement according to which said track member comprises two identical channel-shaped sheet piles whose section comprises a central web and first and second sidewalls having the same dimensions extending along the sides of said web symmetrically with respect to a longitudinal plane of symmetry of the web, said sidewalls each carrying a flange substantially parallel to said web, said flanges being bent outwardly away from said plane of symmetry, said sheet piles being positioned with their concave surfaces facing each other, the flanges of said first sidewalls separated from each other to form said slot, and the flanges of said second sidewalls rigidly connected to each other by at least one spacer member located therebetween, said at least one spacer member having the cross-sectional shape of an inverted T, with the surfaces of the standing part of the T in contact with two flanges of the sheet piles and the arms of the cross-bar of the T in contact with the inner surface of two sidewalls of the sheet piles.

2. Member as claimed in claim 1 in which the central webs of the two sheet piles are substantially parallel and the two surfaces of the spacer member in contact with the two flanges the sheet piles are substantially parallel.

3. In hollow track member for a material handling installation comprising at least two elongated members defining a longitudinal slot extending longitudinally thereof and adapted to receive at least one traveller, the improvement according to which said track member comprises two identical channel-shaped sheet piles whose section comprises a central web and first and second sidewalls having the same dimensions extending along the sides of said web symmetrically with respect to a longitudinal plane of symmetry of the web, said sidewalls each carrying a flange substantially parallel to said web, said flanges being bent outwardly away from said plane of symmetry, said sheet piles being positioned with their concave surfaces facing each other, and the webs of the two sheet piles converging toward the sidewalls thereof remote from the spacer member, the flanges of said second sidewalls being rigidly connected to each other by at least one spacer member located therebetween and the surfaces of the spacer member in contact with the flanges of the two sheet piles converging in the same direction as said webs.

4. In a hollow track member for a material handling installation comprising at least two elongated members defining a longitudinal slot extending longitudinally thereof and adapted to receive at least one traveller, the improvement according to which said track member comprises two identical channel-shaped sheet piles whose section comprises a central web and first and second sidewalls having the same dimensions extending along the sides of said web symmetrically with respect to a longitudinal plane of symmetry of the web, said sidewalls each carrying a flange substantially parallel to said web, said flanges being bent outwardly away from said plane of symmetry, said sheet piles being positioned with their concave surfaces facing each other, with the flanges of said second sidewalls rigidly connected to each other by at least one spacer member located therebetween, the webs of the two sheet piles converging toward the sidewalls carrying the flanges which contact the spacer member, and the surfaces of the spacer member in contact with the flanges of the two sheet piles converging in the same direction.

* * * * *